United States Patent [19]

Nakatani et al.

[11] Patent Number: 4,839,238

[45] Date of Patent: Jun. 13, 1989

[54] FIBER-REINFORCED METALLIC COMPOSITE MATERIAL

[75] Inventors: Mitsuhisa Nakatani, Funabashi; Ken-ichi Nishio, Shiga, both of Japan

[73] Assignee: Sumitomo Chemical Company, Limited, Osaka, Japan

[21] Appl. No.: 289,524

[22] Filed: Dec. 27, 1988

Related U.S. Application Data

[63] Continuation of Ser. No. 146,579, Jan. 21, 1988, abandoned.

[30] Foreign Application Priority Data

Feb. 10, 1987 [JP] Japan ..... 62-28578

[51] Int. Cl.[4] ..... C22C 1/09

[52] U.S. Cl. ..... 428/614

[58] Field of Search ..... 428/608, 614, 611; 164/97; 420/417, 491, 554, 441, 402

[56] References Cited

U.S. PATENT DOCUMENTS

| | | | |
|---|---|---|---|
| 4,012,204 | 3/1977 | Riewald et al. | 29/191.2 |
| 4,050,997 | 9/1977 | Heissler et al. | 204/28 |
| 4,053,011 | 10/1977 | Riewald et al. | 164/97 |
| 4,157,409 | 6/1979 | Levitt et al. | 428/608 |
| 4,452,865 | 6/1984 | Yamatsuta et al. | 428/614 |
| 4,489,138 | 12/1984 | Yamatsuta et al. | 428/614 |
| 4,526,841 | 7/1985 | Yamatsuta et al. | 428/614 |
| 4,544,610 | 10/1985 | Okamoto et al. | 428/614 |
| 4,590,132 | 5/1986 | Dohnomoto et al. | 428/614 |

FOREIGN PATENT DOCUMENTS

| | | | |
|---|---|---|---|
| 3522166 | 7/1986 | Fed. Rep. of Germany . | |
| 141960 | 11/1981 | Japan | 164/97 |
| 2081353A | 2/1982 | United Kingdom | 164/97 |

*Primary Examiner*—John J. Zimmerman

*Attorney, Agent, or Firm*—Birch, Stewart, Kolasch & Birch

[57] ABSTRACT

Improved fiber-reinforced metallic composite material includes as a matrix a metal or alloy of aluminum, magnesium, copper, nickel or titanium and as a reinforcing material an inorganic fiber of 15 to 70% by volume, which is characteristic in that the metal alloy composing the matrix contains 0.05 to 10% by weight of lead or a combination of 0.05 to 10% by weight of lead and 0.01 to 5% by weight of one or more metals selected from the group consisting of sodium, potassium, calcium, strontium, cesium, barium and radium. The composite material has improved mechanical strength, particularly tensile strength, and is useful as a material for various parts and devices in various industrial fields such as the aerospace, atomic power and automobile industries.

12 Claims, No Drawings

FIBER-REINFORCED METALLIC COMPOSITE MATERIAL

This application is a continuation, of application Ser. No. 07/146,579 filed on Jan. 21, 1988, now abandoned.

This invention relates to a fiber-reinforced metallic composite material, and more particularly, to a fiber-reinforced metallic composite material comprising a matrix consisting of an alloy incorporated with lead or a combination of lead with one or more metals selected from sodium, potassium, calcium, strontium, cesium, barium and radium which is reinforced with a fiber and has excellent mechanical strength. (The fiber-reinforced metallic composite material will, hereinafter, be referred to merely as "composite material").

BACKGROUND OF THE INVENTION

There have recently been developed and utilized in various industrial fields some composite materials comprising an inorganic fiber (e.g. alumina fiber, silica fiber, silicon carbide fiber, boron fiber, etc.) and a matrix consisting of a metal selected from aluminum, magnesium, copper, nickel, titanium, etc. or an alloy thereof.

When the metals or metal alloys as mentioned above are reinforced with the inorganic fiber, a reaction proceeds at the interface of the inorganic fiber and the molten or high temperature metals or metal alloys to form a brittle layer, which causes a lowering of the strength of the composite material, and thereby, the composite material exhibits lower strength than the theoretical one. For instance, a commercially available carbon fiber has a strength of about 300 kg/mm$^2$, and it is used for reinforcing metals or metal alloys, assuming that the fiber material will occupy 50% by volume in the composite material, the composite material will theoretically have a strength of about 150 kg/mm$^2$ even though the strength due to the matrix material is neglected. In fact, in the case of a carbon fiber-reinforced composite material using a matrix of an epoxy resin, the composite material has a strength of about 150 kg/mm$^2$ or more. However, when a matrix of aluminum is used and the composite material is prepared therewith by a molten metal impregnating method, the resulting carbon fiber-reinforced composite material has a strength of about 30–40 kg/mm$^2$. This is due to the interfacial reaction induced by contacting the fiber with a molten metal and thereby deteriorating the properties of the carbon fiber. It has been proposed to improve such deterioration of fibers by various means, for example, by treating the surface of the fiber with a coating agent, but this method is not practically suitable because of troublesome handling and/or the high cost.

BRIEF DESCRIPTION OF THE INVENTION

The present inventors have intensively studied to improve the strength of the composite material by an easily available method, and have found that the desired composite material having excellent mechanical strength, particularly excellent tensile strength, can be obtained by using a matrix consisting essentially of an alloy of the conventional metals (hereinafter, referred to as "matrix metals") incorporated with lead or a combination of lead with one or more metals selected from sodium, potassium, calcium, strontium, cesium, barium and radium.

An object of this invention is to provide an improved fiber-reinforced metallic composite material having excellent mechanical strength.

Another object of the invention is to provide a fiber-reinforced metallic composite material using as a matrix an alloy of the conventional metals incorporated with lead or a combination of lead with one or more metals selected from sodium, potassium, calcium, strontium, cesium, barium and radium.

These and other objects and advantages of the invention will be apparent to those skilled in the art from the following description.

DETAILED DESCRIPTION OF THE INVENTION

The composite material of this invention comprises as a matrix a metal or alloy of aluminum, magnesium, copper, nickel or titanium and as a reinforcing material an inorganic fiber of 15 to 70% by volume, which is characteristic in that the alloy composing the matrix contains 0.05 to 10% by weight of lead or a combination of 0.05 to 10% by weight of lead and 0.01 to 5% by weight of one or more metals selected from the group consisting of sodium, potassium, calcium, strontium, cesium, barium and radium.

The inorganic fiber used in this invention includes carbon fiber, silica fiber, silicon carbide fiber, boron fiber, alumina fiber, and the like. The inorganic fibers are contained in the composite material of this invention in an amount of 15 to 70% by volume based on the whole volume of the composite material. When the amount of the fibers is less than 15% by volume, the desired reinforcing effect cannot sufficiently be achieved, and on the other hand, when the amount is over 70% by volume, the strength of the composite material is lowered due to the mutual contact of fibers. The fibers may have any form, such as long fibers or short fibers, and any form of fibers can be used depending on the desired utilities of the product. These forms of fibers may be used alone or in a combination thereof. The fibers are applied to in various orientations, such as unidirectional crossplying, random orientation, and the like in order to give the desired mechanical strength and elasticity. Among these inorganic fibers, the most preferable fiber for achieving the desired reinforcing effect is alumina fiber as disclosed in Japanese Patent Second Publication (Kokoku) No. 13768/1976, i.e. the alumina fiber having an alumina ($Al_2O_3$) content of 72 to 100% by weight, preferably 75 to 98% by weight, and a silica ($SiO_2$) content of 0 to 28% by weight, preferably 2 to 25% by weight, and exhibiting substantially no reflection by X-ray diffraction due to the $\alpha$-$Al_2O_3$ structure. This alumina fiber may optionally be incorporated with a fire-retardant compound, for example, one or more oxide compounds of metals selected from lithium, beryllium, boron, sodium, magnesium, silicon, phosphorus, potassium, calcium, titanium, chronium, manganese, yttrium, zirconium, lanthanum, tungsten, barium, and the like, unless they do not effect the desired properties.

The matrix metals used in this invetnion include metals or alloys of aluminum, magnesium, copper, nickel or titanium (provided that these alloys do not contain lead, sodium, potassium, calcium, strontium, cesium, barium or radium). When the composite material is required to have light weight and to have high strength, aluminum, magnesium, or an alloy thereof are preferable. When the composite material is required to have heat resistance and high strength, the metals or alloys of copper, nickel or titanium are preferable. These matrix metals may optionally contain a slight amount of impure elements unless they produce an undesireable effect.

This invention is characteristic in that the abovementioned matrix metals incorporated with 0.05 to 10% by weight of lead or a combination of 0.05 to 10% by weight of lead and 0.01 to 5% by weight of one or more metals selected from sodium, potassium, calcium, strontium, cesium, barium and radium are used as a matrix, and thereby, the undesirable reaction at the fiber/matrix interface is effectively inhibited to give the desired composite material having the excellent strength close to the theoretical strength.

The mechanism of improvement of strength due to the matrix metals incorporated with the above-mentioned specific metals may be assumed as follows.

In the process for producing a composite material from the matrix metals in the molten state and the inorganic fibers, at the step of coagulation by cooling, the inorganic fibers are cooled more slowly than the matrix metals, and hence, lead contained in the matrix metals, which has a low melting point (327.4° C.), is not compatible with the matrix metals and precipitates out around the inorganic fibers to form a coating on the inorganic fibers.

Since lead is inactive to the inorganic fibers, it is effective for inhibiting the reaction between the inorganic fibers and the matrix metals and still has an appropriate adhesion to the inorganic fibers and the matrix metals, by which the strength of the composite material is extremely improved.

Moreover, when a combination of lead with one or more metals selected from sodium, potassium, calcium, strontium, cesium, barium and radium is incorporated into the matrix metals, it gives more effective improvement of the strength of the composite material than the case of incorporation of lead alone. In this case, the mechanism of the improvement of strength may be assumed as follows.

When the metal selected from sodium, potassium, calcium, strontium, cesium, barium and radium is incorporated into the matrix metals, the surface of the matrix metals has a higher concentration of element of the incorporated metal than the mean concentration thereof within the whole matrix. For instance, when aluminum is used as the matrix metal and strontium or barium is incorporated in an amount of 0.1% by mole, the concentration of the incorporated element becomes higher at the surface of the matrix than the mean concentration as shown by Gibbs' adsorption isothermal equation, and thereby, the resulting composite material has a surface tension of 60 or 300 dyne/cm, respectively. The incorporated element is present in a higher concentration at the fiber/matrix interface, and thereby inhibits the interfacial reaction. When lead and other metals such as sodium, potassium, calcium, strontium, cesium, barium or radium are present around the inorganic fibers, the interfacial reaction is more effectively inhibited.

In addition, when the inorganic fiber-reinforced metallic composite having a matrix composed by an alloy incorporated with the specific metal is observed by a scanning electron microscope at a rupture cross-section thereof, the composite material has a weaker binding at the fiber/matrix interface than the composition material obtained from a matrix of an alloy to which no additional metal is incorporated. It is also observed that there is not present a reaction phase between the fiber and the matrix which is usually observed at around the periphery of fibers, and the reaction at the fiber/matrix interface is decreased.

The lead or a combination thereof with a metal selected from sodium, potassium, calcium, strontium, cesium, barium and radium is incorporated in such an amount as follows: 0.05 to 10% by weight, preferably 0.1 to 5% by weight, of lead based on the weight of the matrix metals, and 0.01 to 5% by weight, preferably 0.01 to 2% by weight, or the total amount of the metals to be incorporated selected from sodium, potassium, calcium, strontium, cesium, barium and radium.

When lead is incorporated in an amount of less than 0.05% by weight, the desired improvement in the properties on the composite material cannot sufficiently be achieved, but on the other hand, when the amount of lead is over 10% by weight, the matrix metals lose the original excellent properties, that is, the show a lowering of corrosion resistance and a lowering of tensile further, the reaction of the fiber/matrix interface is completely inhibited, by which the composite material shows less improvement in the strength. When the metals such as sodium, potassium, calcium, strontium, cesium, barium and radium are incorporated in an amount less than 0.01% by weight, the desired improvement of the properties is not sufficiently achieved, and on the other hand, when the amount is over 5% by weight, the matrix metals lose their original excellent properties. Specially, they show a lowering of corrosion resistance and a lowering of tensile elongation, and further, the composite material shows less improvement in the strength.

The lead and the metals of sodium, potassium, calcium, strontium, cesium, barium and radium can be incorporated into the matrix metals by various methods, for example, by a conventional method for producing alloys. For instance, a matrix metal is molten in a vessel in air or under an inert atmosphere, and thereto are added lead and other metals such as sodium, potassium, calcium, strontium, cesium, barium and radium, and the mixture is well stirred and then cooled.

The composite material of this invention can be prepared by various methods, for instance, (1) a liquid phase method (e.g. a liquid metal impregnation method), (2) a powder metallurgy method (e.g. sintering, welding, etc.), (3) a deposition method (e.g. flame spraying, electrodeposition, flashing, etc.), (4) a plastic processing (e.g. extrusion, calendering, etc.), (5) a high-pressure coagulation casting method, and the like. The desired effect of this invention is particularly well exhibited in the case of the (1) liquid metal impregnation method and (5) high-pressure coagulation casting method, but may also be exhibited in other methods (2) to (4).

This invention is illustrated by the following Examples, but should not be construed to be limited thereto.

EXAMPLES 1-4 AND COMPARATIVE EXAMPLE 1

Pure aluminum (purity, 99.98%) (1,000 g) is taken in a graphite crucible and is molten at about 700° C. under an argon atmosphere. Lead (purity, 99.9%) (10 g) is added to the above vessel, and the mixture is stirred well with a carbon steel bar coated with mica flour on the surface thereof to produce an Al-Pb(1.0% by weight) alloy. Separately, two Al-Pb(1.0% by weight) alloys are prepared likewise, and are each taken in a graphite crucible and molten at 700° C. To one crucible is added barium (5.0 g) to produce an Al-Pb(1.0% by weight)-Ba(0.5% by weight) alloy, and to another one is added calcium (3.0 g) to produce an Al-Pb(1.0% by weight)-Ca(0.3% by weight) alloy. In the same manner as above, there is produced an Al-Pb(0.5% by weight)-Ba(0.5% by weight)-Ca(0.5% by weight) alloy.

Alumina fibers ($Al_2O_3$ content: 85% by weight, $SiO_2$ content: 15% by weight, mean fiber size: 14 μm, tensile strength: 180 kg/mm$^2$, tensile modulus: 23,500 kg/mm$^2$) are used as an inorganic fiber. The fibers are arranged unidirectionally in a size of longitudinal length of 100 mm, horizontal length of 200 mm and a height of 6 mm. The resulting fibers are heated at 600° C. in a nichrome furnace. A plunger pressing mold is charged with fibers which are previously heated, and the above alloy molten at 850° C. is poured into the cylinder and then pressed at 600 kg/cm$^2$ with a plunger, and thereby the alloy is coagurated under pressure to obtain plate-shaped fiber-reinforced metallic composite materials.

For comparison purposes, a fiber-reinforced metallic composite material is prepared by using pure aluminum (purity, 99.98%) alone as a matrix in the same manner as described above.

The fiber-reinforced metallic composite materials all have 50% by volume of the fiber content.

Test samples for tensile strength were prepared from the above fiber-reinforced metallic composite materials. The tensile strength was measured at room temperature by a method as defined in ASTM E8-82. The results are shown in Table 1.

TABLE 1

| No. | Matrix | Tensile strength (kg/mm$^2$) |
|---|---|---|
| 1 | Al—1.0% Pb | 95 |
| 2 | Al—1.0% Pb—0.5% Ba | 120 |
| 3 | Al—1.0% Pb—0.3% Ca | 110 |
| 4 | Al—0.5% Pb—0.5% Ba—0.5% Ca | 120 |
| Comp. Ex. 1 | Al | 80 |

[Note]: "%" in the above table means % by weight.

EXAMPLES 5 TO 8 AND COMPARATIVE EXAMPLE 2

In the same manner as described in Examples 1–4, there are prepared Al-Pb(1.0% by weight) alloy, Al-Pb(3.0% by weight) alloy, Al-Pb(1.0% by weight)-Na(0.01% by weight) alloy, and Al-Pb(1.0% by weight)-Ba(0.5% by weight) alloy as a matrix. The same alumina fiber as used in Examples 1–4 is used as the inorganic fiber and is entered by drawing into a tubular mold (inner diameter 4 mm). The above-mentioned alloys are each molten at 700° C. under an argon atmosphere, and thereto is dipped one end of the above tubular mold, and a pressure (50 kg/cm$^2$) is given onto the surface of the molten alloy while deaerating the tubular mold by drawing air from another end thereof, by which the molten alloy is impregnated between fibers. The resultant product is cooled to obtain fiber-reinforced metallic composite materials.

For comparison purpose, a fiber-reinforced metallic composite material is prepared by using pure aluminum (purity, 99.98%) alone as a matrix in the same manner as described above.

The fiber-reinforced metallic composite materials all have 50% by volume of the fiber content.

Test samples for tensile strength were prepared from the above fiber-reinforced metallic composite materials. The tensile strength was measured at room temperature likewise. The results are shown in Table 2.

TABLE 2

| No. | Matrix | Tensile strength (kg/mm$^2$) |
|---|---|---|
| 5 | Al—1.0% Pb | 90 |
| 6 | Al—3.0% Pb | 75 |
| 7 | Al—1.0% Pb—0.01% Na | 95 |
| 8 | Al—0.5% Pb—0.5% Ba | 110 |
| Comp. Ex. 2 | Al | 70 |

[Note]: "%" in the above table means % by weight.

EXAMPLES 9 TO 12 AND COMPARATIVE EXAMPLE 3

In the same manner as described in Examples 1–4, there are prepared Al-Pb(0.5% by weight) alloy, Al-Pb(1.0% by weight)-Cs(0.02% by weight) alloy, Al-Pb(0.5% by weight)-Ca(0.3% by weight) alloy, and Al-Pb(0.5% by weight)-Sr(0.5% by weight) alloy as a matrix. Carbon fiber (manufactured by Sumika-Hercules, mean fiber size: 8 μm, tensile strength: 370 kg/mm$^2$, tensile modulus: 23,600 kg/mm$^2$) is used as the inorganic fiber. In the same manner as described in Examples 5–8, there are obtained fiber-reinforced metallic composite materials.

For comparison purposes, a fiber-reinforced metallic composite material is prepared by using pure aluminum (purity, 99.98%) alone as a matrix in the same manner as described above.

The fiber-reinforced metallic composite materials all have 60% by volume of the fiber content.

Test samples for tensile strength were prepared from the above fiber-reinforcing metallic composite materials. The tensile strength was measured at room temperature likewise. The results are shown in Table 3.

TABLE 3

| No. | Matrix | Tensile strength (kg/mm$^2$) |
|---|---|---|
| 9 | Al—0.5% Pb | 80 |
| 10 | Al—1.0% Pb—0.02% Cs | 85 |
| 11 | Al—0.5% Pb—0.3% Ca | 95 |
| 12 | Al—0.5% Pb—0.5% Sr | 100 |
| Comp. Ex. 3 | Al | 60 |

[Note]: "%" in the above table means % by weight.

EXAMPLES 13 TO 14 AND COMPARATIVE EXAMPLES 4 TO 5

In the same manner as described in Examples 1–4, there are prepared Cu-Pb(1.0% by weight)-Ba(0.1% by weight) alloy and Ni-Pb(1.0% by weight)-Sr(0.1% by weight) alloys a matrix. The same alumina fiber as used in Examples 1–4 is used as the inorganic fiber. In the same manner as described in Examples 1–4 except that the alloys as mentioned above are each molten at a temperature of a melting point thereof, there are obtained fiber-reinforced metallic composite materials.

For comparison purpose, a fiber-reinforced metallic composite material is prepared by using pure copper or pure nickel respectively as a matrix in the same manner as described above.

The fiber-reinforced metallic composite materials all have 50% by volume of the fiber content.

Test samples for tensile strength were prepared from the above fiber-reinforced metallic composite materials. The tensile strength was measured at room temperature likewise. The results are shown in Table 4.

TABLE 4

| No. | Matrix | Tensile strength (kg/mm$^2$) |
|---|---|---|
| 13 | Cu—1.0% Pb—0.1% Ba | 140 |
| 14 | Ni—1.0% Pb—0.1% Sr | 160 |
| Comp. Ex. 4 | Cu | 100 |
| Comp. Ex. 5 | Ni | 110 |

[Note]: "%" in the above table means % by weight.

As is shown in the above examples, the composite material of this invention has significantly improved mechanical strength in comparison with the conventional products produced without incorporating any specific metal into the matrix metal, and further, the composite material of this invention can readily be produced by a conventional method and apparatus, which is very advantageous from an industrial viewpoint, too.

What is claimed is:

1. A fiber-reinforced metallic composite material, which comprises as a matrix a metal selected from the group consisting of aluminum, magnesium, copper, nickel and titanium and an alloy thereof, and as a reinforcing material an inorganic fiber of 15 to 70% by volume, said metal alloy composing the matrix containing a combination of 0.05 to 10% by weight of lead and 0.01 to 5% by weight of at least one metal selected from the group consisting of sodium, potassium, calcium, strontium, cesium, barium and radium.

2. The fiber-reinforced metallic composite material according to claim 1, wherein the metal alloy composing the matrix is incorporated with a combination of 0.05 to 10% by weight of lead and 0.01 to 5% by weight of at least one metal selected from the group consisting of sodium, potassium, calcium, strontium, cesium, barium and radium.

3. The fiber-reinforced metallic composite material according to claim 2, wherein the lead is incorporated in an amount of 0.1 to 5% by weight, and the metal selected from sodium, potassium, calcium, strontium, cesium, barium and radium is incorporated in an amont of 0.01 to 2% by weight.

4. The fiber-reinforced metallic composite material according to claim 1, wherein the inorganic fiber is alumina-silica fiber having an alumina content of 72 to 100% by weight and a silica content of 0 to 28% by weight and exhibiting substantially no reflection by X-ray diffraction due to the $\alpha$-$Al_2O_3$ structure.

5. The fiber-reinforced metallic composite material according to claim 4, wherein said fiber is incorporated with a fire-retardant compound selected from the group consisting of an oxide of lithium, beryllium, boron, sodium, magnesium, silicon, phosphorus, potassium, calcium, titanium, chromium, manganese, yttrium, zirconium, lanthanum, tungsten and barium.

6. The fiber-reinforced metallic composite material according to claim 1, wherein the inorganic fiber is a member selected from the group consisting of a carbon fiber, a silica fiber, a silicon carbide fiber, a boron fiber, and an alumina fiber.

7. The fiber-reinforced metallic composite material according to claim 1, wherein the lead is incorporated in an amount of 0.1 to 5% by weight.

8. A fiber-reinforced metallic composite material, which comprises as a matrix a metal selected from the group consisting of aluminum, magnesium, copper, nickel, and titanium and an alloy thereof, and as a reinforcing material an inorganic fiber of 15 to 70% by volume, said metal alloy composing the matrix containing 0.05 to 10% by weight of lead.

9. The fiber-reinforced metallic composite material according to claim 8, wherein the lead is incorporated in an amount of 0.1 to 5% by weight.

10. The fiber-reinforced metallic composite material according to claim 8, wherein the inorganic fiber is alumina-silica fiber having an alumina content of 72 to 100% by weight and a silica content of 0 to 28% by weight and exhibiting substantially no reflection by X-ray diffraction due to the $\alpha$-$Al_2O_3$ structure.

11. The fiber-reinforced metallic composite material according to claim 10, wherein said fiber is incorporated with a fire-retardant compound selected from the group consisting of an oxide of lithium, beryllium, boron, sodium, magnesium, silicon, phosphurous, potassium, calcium, titanium, chromium, manganese, yttrium, zirconium, lanthanum, tungsten and barium.

12. The fiber-reinforced metallic composite material according to claim 8, wherein the inorganic fiber is a member selected from the group consisting of a carbon fiber, a silica fiber, a silicon carbide fiber, a boron fiber, and an alumina fiber.

* * * * *